US005638956A

United States Patent [19]

Sutherland

[11] Patent Number: 5,638,956

[45] Date of Patent: Jun. 17, 1997

[54] WRAP-AROUND CARRIER WITH LOCK-BOX KEEL

[75] Inventor: Robert L. Sutherland, Kennesaw, Ga.

[73] Assignee: Riverwood International Corporation, Atlanta, Ga.

[21] Appl. No.: 570,309

[22] Filed: Dec. 11, 1995

[51] Int. Cl.[6] ..... B65D 75/00

[52] U.S. Cl. ..... 206/434; 206/154; 206/147; 206/160

[58] Field of Search ..... 206/140, 147, 206/152, 154, 160, 193, 197, 434, 427

[56] References Cited

U.S. PATENT DOCUMENTS

| | | | |
|---|---|---|---|
| 3,128,034 | 4/1964 | Weiss | 206/154 |
| 3,216,612 | 11/1965 | Chidsey, Jr. | 206/154 |
| 4,489,880 | 12/1984 | Calvert | 206/434 |
| 4,703,847 | 11/1987 | Oliff | 206/434 |
| 4,756,419 | 7/1988 | Le Bras | 206/140 |
| 5,107,986 | 4/1992 | Cooper | 206/434 |
| 5,484,059 | 1/1996 | Sutherland | 206/434 |

FOREIGN PATENT DOCUMENTS

| | | | |
|---|---|---|---|
| 461947 | 12/1991 | European Pat. Off. | 206/147 |

*Primary Examiner*—David T. Fidei

[57] ABSTRACT

A wrap-around carrier suitable for packaging tapered tub-shaped articles. A side panel of a hollow rectangular center keel is connected to a bottom panel flap and to an attachment flap formed at an end of the carrier blank. The keel top panel includes recesses for receiving the tapered articles and the side panels include heel cutouts as well as means for allowing the side panels to flex inwardly to accommodate the shape of the articles. A top divider connected to the top panel lies between the top portions of adjacent articles in adjacent rows.

12 Claims, 4 Drawing Sheets

WRAP-AROUND CARRIER WITH LOCK-BOX KEEL

FIELD OF THE INVENTION

This invention relates to wrap-around article carriers. More particularly, it relates to wrap-around article carriers for packaging tapered articles, such as tubs of the type which contain soft food products.

BACKGROUND OF THE INVENTION

Wrap-around article carriers are commonly designed to have ends which are either partially or entirely open. In either case the carriers must be provided with means for securely holding the articles in place. Beverage cans, for example, are held in place partly by the tension of the tightly wrapped carrier and by engagement of the top and bottom flanges of the cans with the edges of cutouts in the side panels of the carrier. That design is facilitated by the fact that the side walls of beverage cans are of substantially constant diameter, which allows the carrier blank to be tightly wrapped around the cans.

Problems arise when the articles are not of uniform dimensions, particularly when the articles are tapered toward the bottom, which causes the bottom portions of articles in adjacent rows to be spaced apart. Wrap-around carriers for use with tapered tubs of the type used as soft food containers are especially troublesome because of the difficulty in wrapping them tightly enough to prevent movement of the tubs when the package is lifted and carried. Movement of the containers is a problem even when the carrier includes side slots through which flanges on the tops of the tubs protrude, since such an arrangement does not hold the bottom portions of the tubs tightly in place.

Partial end panels extending up from the bottom panel could be provided to function as article retainers, as could corner end gusset panels or flaps. These measures are not entirely satisfactory, however, because they do not prevent movement of the bottom portions of the containers toward and away from each other. To overcome these problems it has been suggested to provide retaining flaps which are wedged between the bottom portions of adjacent tubs to hold them in place. Although this prevents the spaced bottom portions of articles from moving with respect to each other and toward the open end of the carrier, it does not allow commonly employed more economical mechanical locks to be utilized. Further, the tubs are not supported against movement throughout the length of the carrier but only at the carrier ends. It would be desirable to provide article retaining means which are separate from the bottom panel locking means and which are able to provide support to the article bottoms throughout the length of the carrier.

BRIEF SUMMARY OF THE INVENTION

In accordance with the invention, a wrap-around carrier is provided for packaging a plurality of adjacent rows of articles the bottom portions of which are spaced apart. The carrier includes a top panel, side panels and a bottom panel comprised of bottom panel flaps. A keel extends substantially parallel to the side edges of the bottom panel flaps and is substantially equally spaced from the side panels. The keel is comprised of a plurality of panels, each connected to an adjacent keel panel by fold lines, with one of the keel panels being foldably connected to a bottom panel flap.

In a preferred embodiment the keel is rectangular in transverse cross-section and includes a bottom panel adjacent the bottom panel of the carrier, the keel bottom panel including outwardly extending tabs located between an associated article and the bottom panel. This locks the keel in place and prevents the keel and carrier from collapsing. Preferably, an attachment flap is mechanically connected to the inner keel side panel to complete the keel structure. The side panels of the keel may be constructed to permit them to flex inwardly so as to receive the tapered shape of packaged articles. The top keel panel may be recessed for the same reason.

In addition, the carrier may include a divider tab extending downwardly from the top panel between upper portions of adjacent articles in adjacent rows. In a preferred construction the divider tab is of folded two-ply construction, with an edge of the folded portion engaging the underside of the top panel to frictionally hold the divider tab in place while articles to be packaged are being arranged on the carrier blank.

The carrier is of very sturdy construction and protects against article movement and collapsing of the carrier. It is also economical and simple to fabricate from a unitary blank. The above and other aspects of the invention, as well as other benefits, will readily be apparent from the more detailed description of the preferred embodiment which follows.

DETAILED DESCRIPTION OF THE PREFERRED EMBODIMENT

Figure 1:
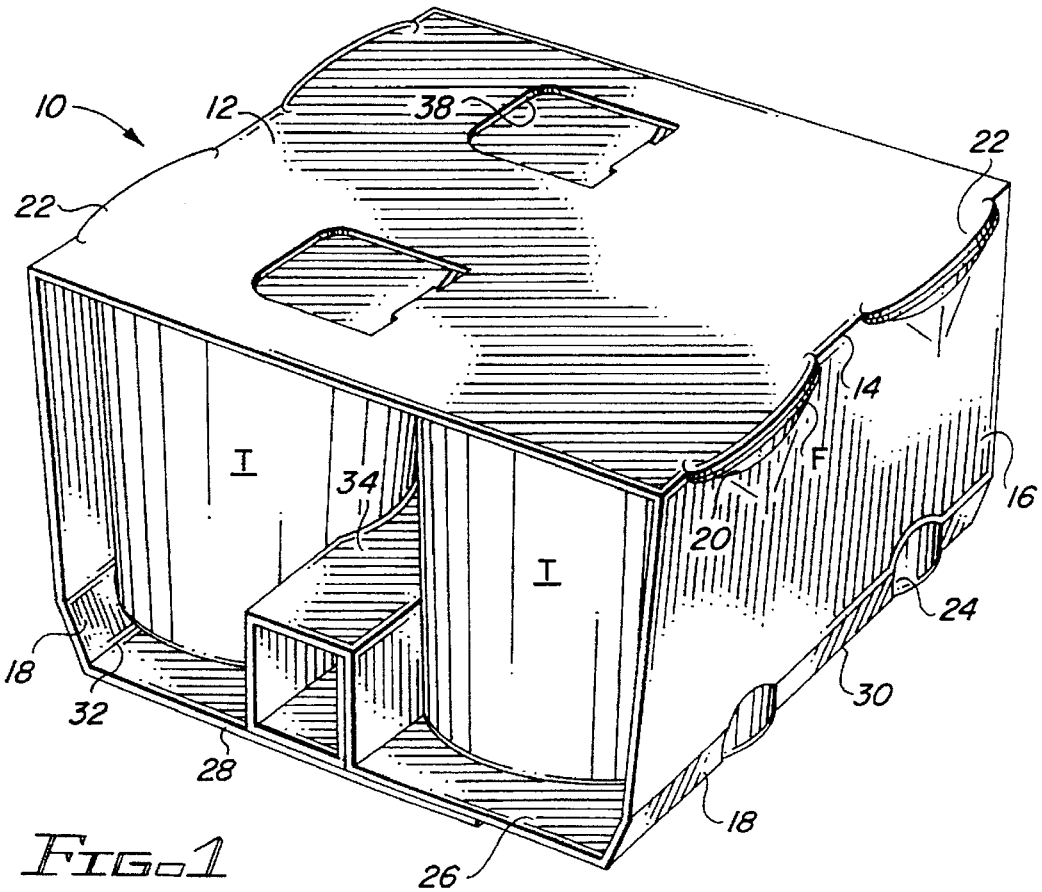
FIG. 1 is a pictorial view of a wrap-around carrier incorporating the box keel arrangement of the invention.
Figure 2:
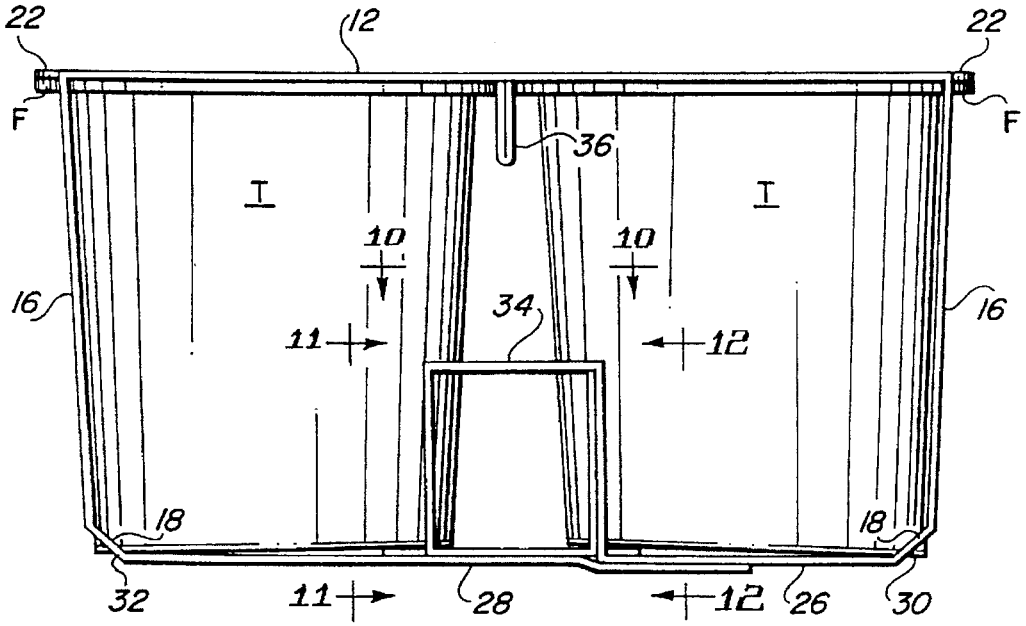
FIG. 2 is an end view of the carrier of FIG. 1.

Referring to FIGS. 1 and 2, a wrap-around carrier 10 comprises a top panel 12 connected along fold lines 14 to side panels 16 which generally follow the contour of the four tapered articles T in the carrier. For the purpose of illustrating the invention, the articles T are shown as comprising tubs of the type used to contain soft food, such as yogurt or pudding or the like. The side panels are additionally tapered at the bottom portion of the carrier to form bevel panels 18. The side panels adjacent the top panel are provided with cutouts or apertures 20 through which the flanges F of the tubs T extend. Tabs 22 extending out from the top panel 12 cover the protruding flanges of the tubs. Cutouts 24 are also provided in the bevel panels 18 through which the bottom portions of the tubs extend.

The bottom panel of the carrier is formed by overlapped inner and outer bottom panel flaps 26 and 28. The inner bottom panel flap 20 is connected to one of the side panels 16 along fold line 30 while the outer bottom panel flap 28 is connected to the other side panel 16 along fold line 32. Extending up from the bottom panel between the adjacent rows of tubs is a center keel 34. The center keel is rectangular in transverse cross-section and has an open-ended box-like configuration which fits snugly between the angled bottom portions of the tubs T, preventing the bottom portions from moving toward or away from each other and enabling the blank forming the carrier to be wrapped tightly about the tubs. As explained in more detail below, the keel is integrally connected to the inner bottom panel flap 26. In addition, center dividers 36 extend down from the top panel 12, separating the flanges of the adjacent rows of tubs from each other. Also, the top panel includes openings 38 which can be used to lift the carrier.

Figure 3:
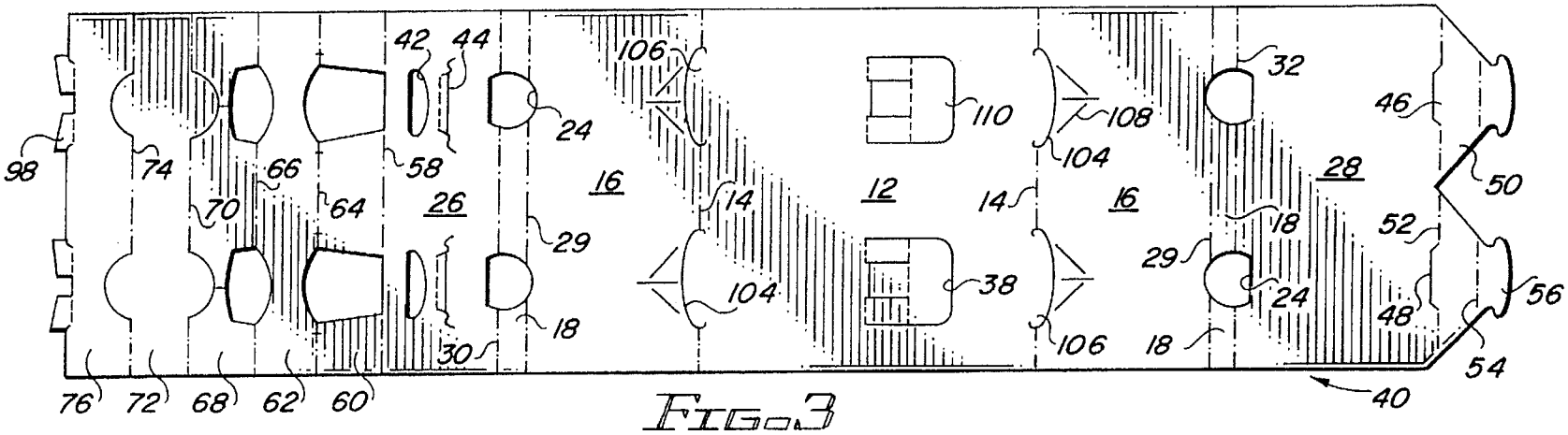
FIG. 3 is a plan view of a blank for forming the carrier of FIG. 1.

As shown in FIG. 3, wherein like reference numerals to those used in FIGS. 1 and 2 denote like elements, a blank for forming the carrier 10 comprises a substantially rectangular sheet 40 of paperboard or other suitable material having adequate flexibility and strength. The top panel section 12 is located in the interior of the blank, with the side panel sections 16, the bevel panel sections 18 and the bottom panel flaps 26 and 28 being successively connected along the fold lines 29, 30 and 32. The inner bottom panel flap 26, which is located in the interior of the blank, includes two spaced primary locking openings 42 and two aligned secondary locking slits 44. The outer bottom panel flap 28 is located at one end of the blank and includes two primary locking tabs 46 which are aligned with the locking openings 42 and are formed by slits 48. Secondary locking tabs 50 are connected to the bottom panel flap 28 by fold lines 52 extending from the ends of the slits 48. Transverse fold lines 54 in the secondary locking tabs form outer tab portions 56 which are aligned with the secondary locking slits 44.

Figure 4:
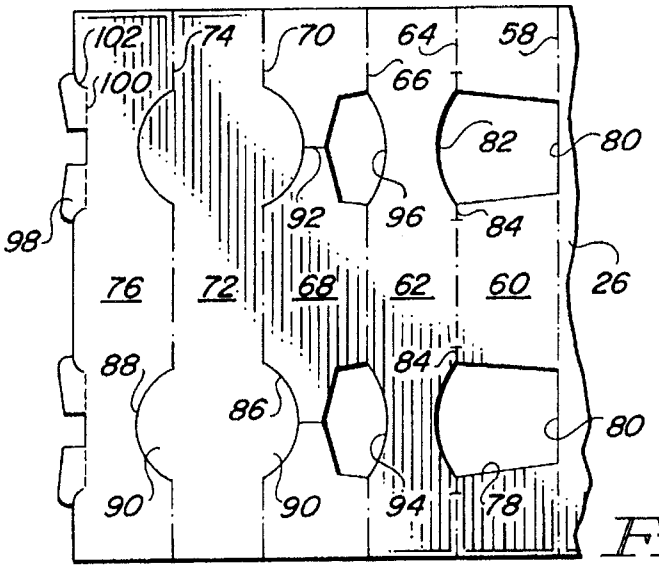
FIG. 4 is an enlarged plan view of the portion of the blank which forms the box keel.

Referring to FIG. 4 as well as FIG. 3, the end of the inner bottom panel flap 26 opposite the fold line 30 is connected by fold line 58 to a first keel side panel section 60. Keel bottom panel section 62 is connected by fold line 64 to the keel side panel section 60 and by fold line 66 to a second keel side panel section 68. Connected to the second keel side panel section 68 by fold line 70 is keel top panel section 72, which in turn is connected by fold line 74 to keel attachment flap 76. Heel cutouts 78 in the first keel side panel section 60 include straight edges 80, which interrupt the fold line 58, and opposite arcuate edges 82 which interrupt the fold line 64. Slits 84 extend out from the edges 82 to the fold line 64 and are aligned with the fold line 64.

The fold lines 70 and 74 are interrupted by opposite arcuate slits 86 and 88 which form locking ears or tabs 90 when the keel top panel section 72 is folded about the fold lines 70 and 74, as explained in more detail below. Short slits 92 extend from the arcuate slits 86 to cutouts 94 which interrupt the fold line 66. The cutouts 94 include arcuate edges 96 which extend into the keel bottom panel section similar to the arcuate edges 82 of the cutouts 78. In addition, the keel attachment flap 76 includes two pairs of spaced locking feet or tabs 98 which are connected to recessed fold lines 100. The outer portions of the locking feet 98 are spaced from the flap 76 by short arcuate slits 102.

Figure 5:
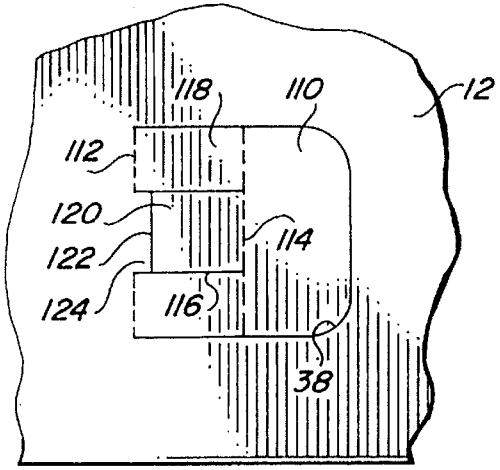
FIG. 5 is an enlarged plan view of the portion of the blank which forms the top divider tabs.

Still referring to FIG. 3, the fold lines 14 are also interrupted by arcuate slits 104 which form tabs 106 when the top panel section is folded about the fold lines 14. A set of three slits 108 preferably are provided in the side panel sections 16 adjacent the slits 104 to enable the side panels to be flexed outwardly by an adjacent tub in the package. As best shown in FIG. 5, the openings 38 in the top panel section are covered by flaps 110 which are connected to the top panel section along spaced fold lines 112. The flaps 110 also include an interior fold line 114, which is substantially parallel to the fold lines 112. A U-shaped slit 116 meets the fold line 114 to form flap legs 118 and a tab 120, with the base portion 122 of the slit 116 being inwardly recessed from the fold lines 112 to form a short ledge portion 124 in the top panel section.

Figure 6:
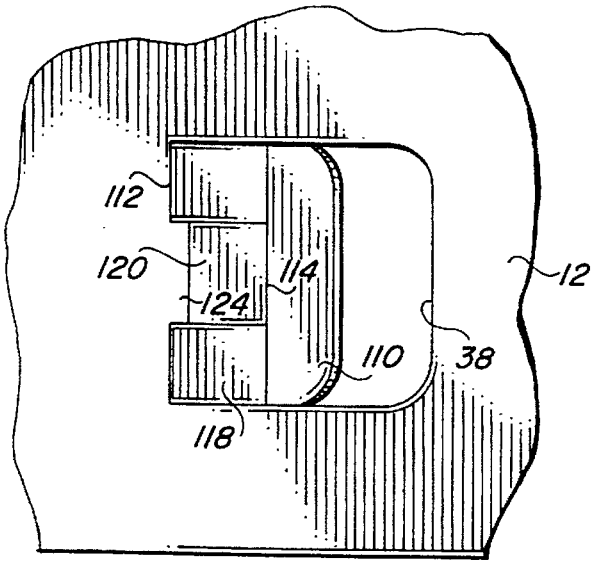
FIG. 6 is a partial plan view of one of the top panel openings showing the top divider tab at an initial stage of formation.
Figure 7:
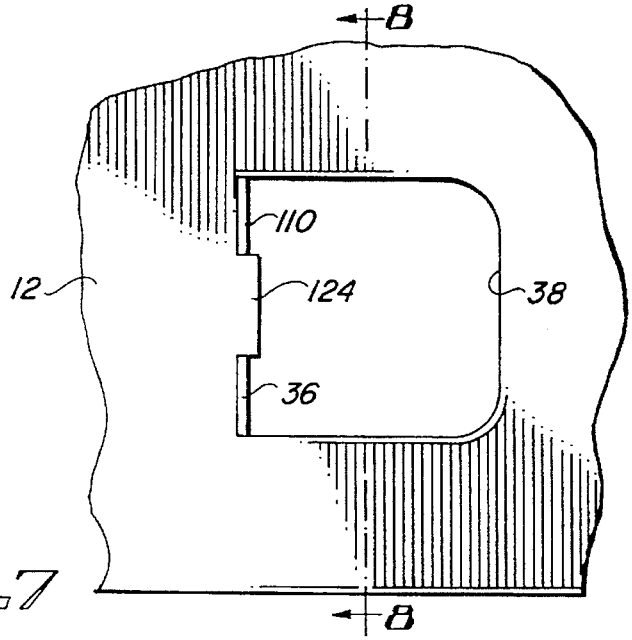
FIG. 7 is a partial plan view similar to that of FIG. 6, but showing the top divider tab after it has been fully formed.
Figure 8:
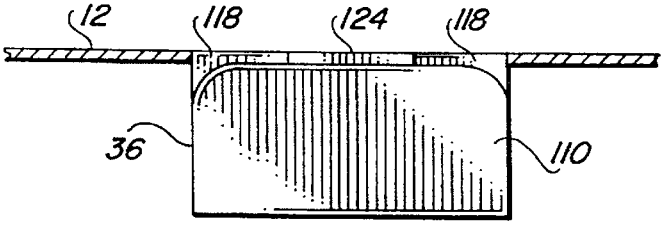
FIG. 8 is a sectional view of the top divider tab taken along line 8—8 of FIG. 7.

To form a carrier from the blank the top center dividers 36 are first formed from the flaps 110 covering the openings 38 in the top panel. Referring to FIG. 5, this is done by first folding the flaps 110 down about the fold lines 112 while at the same time folding the flaps up about the fold line 114. The flap at an interim stage of this folding process is illustrated in FIG. 6. The flap is continued to be folded in this manner until the edge of the flap engages the lower surface of the ledge 124, as shown in FIGS. 7 and 8. The friction fit of the folded flap against the ledge 124 is sufficient to maintain the flap in this vertical folded condition, thus creating the two-ply dividers 36.

Figure 9:
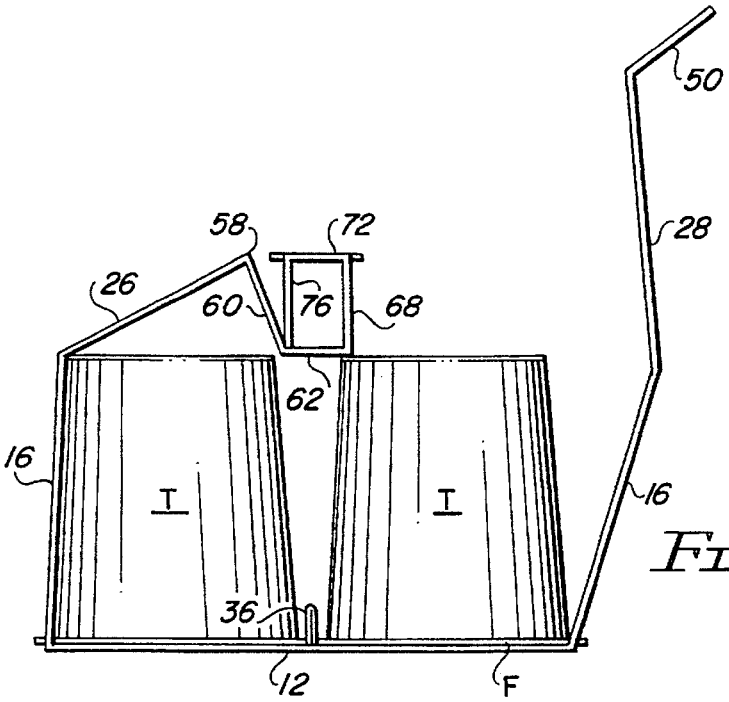
FIG. 9 is a schematic side elevation showing the carrier at an initial stage of formation.

The tubs to be packaged are then placed in inverted condition on the inner face of the top panel section of the blank so that their flanges F abut the dividers 36 and the center keel 34 is formed from the box sections 60, 62, 68, 72 and 76. Referring to the enlarged plan view of these sections in FIG. 4 and to the schematic illustration of the box keel in FIG. 9, it can be seen that the box keel is formed by folding the keel side panel section 60 down about the fold line 58 and then successively folding the remaining keel panel sections 62, 68, 72 and 76 in the opposite direction. The box keel at this stage of formation is illustrated in FIG. 9, which shows the keel to be partially formed but not yet moved into place between the bottoms of the tubs. To complete the formation of the box keel and the bottom panel of the carrier, the keel side panel section 60 and the keel attachment flap 76 are brought together in face-to-face relationship and the tabs 98 of the attachment flap 76 are inserted into the slits 84 in the fold line 64. This brings the formed box keel into alignment with the space between the tubs T, after which the bottom panel flap 26 and the box keel are moved down into their final positions. The bottom panel is then formed by folding the bottom panel flap 28 into place and pushing the primary and secondary locking tabs 46 and 56 into locking relationship with the primary opening 42 and the secondary slit 44 in the bottom panel flap 26. The carrier now appears as in FIGS. 1 and 2. The elements of the box keel are indicated in both drawing figures.

When the box keel is formed the locking tabs 90 remain in the same plane as the keel panel section 72. The portions of the blank previously occupied by the locking tabs 90 thereby become heel cutouts defined by the edges of the slits 86 and 88. As the attachment flap 76 and the keel side panel section 60 are brought into contact, the outwardly extending locking tabs 90 of the keel bottom panel section 72 adjacent the attachment flap 76 are moved into place between the bottom of the adjacent tub and the bottom panel flap 26. The opposite locking tabs 90 also contact the bottom of the adjacent tub and, after the bottom panel flap 28 is moved into place, lie between the tubs and the bottom panel. Because the locking tabs 90 are trapped between the tubs and the bottom panel of the carrier, they are locked in place, thereby also locking the center keel in place.

Figure 10:
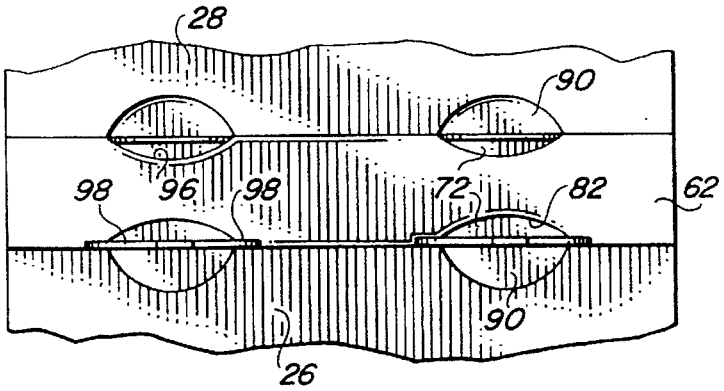
FIG. 10 is an enlarged partial plan view of the box keel taken on line 10—10 of FIG. 2.
Figure 11:
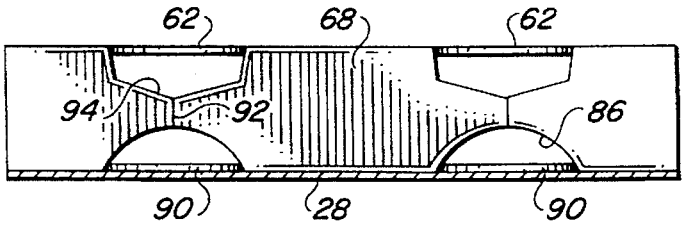
FIG. 11 is an enlarged partial sectional view taken on line 11—11 of FIG. 2.
Figure 12:
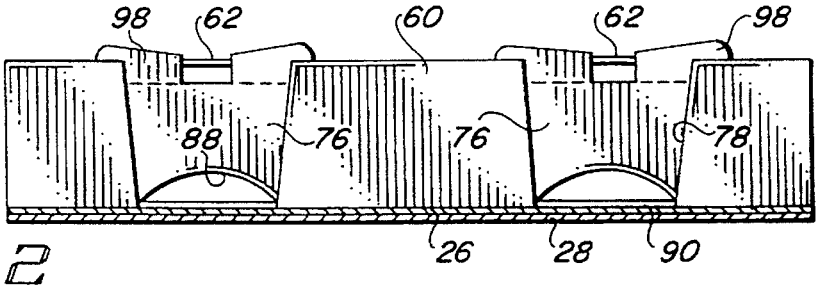
FIG. 12 is an enlarged partial sectional view taken on line 12—12 of FIG. 2.

As shown in FIGS. 4 and 10, the slits 82 and 96 form recesses or cutouts in the keel top panel 62. As shown in FIG. 2, this arrangement allows the lower portions of the tubs to extend into the interior of the center keel for a short distance. Thus, even though the box keel is rectangular in transverse cross-section, the structure of the keel provides support for the tapered side wall of the tubs. As illustrated in FIG. 12, the cutouts 78 in the keel side panel 60 permit the tubs to extend through the side panel 60 into the interior of the box keel. The adjacent attachment flap 76, due to the loose connection between the tabs 98 and the foldable connection of the tabs 98, is able to flex an amount sufficient to enable the tubs to penetrate into the keel to their final position. As shown in FIG. 11, the slits 92 adjacent the cutouts 94 and 86 in the other keel side panel 68 permit the panel to flex inwardly to also enable the tubs to adequately penetrate into the interior of the box keel.

It can now be appreciated that the invention provides a non-collapsible package which holds the tapered tubs in an upright position. The carrier is formed from a single blank even though it includes a divider extending down from the top panel and a keel extending up from the bottom panel. The carrier blank itself is economical to produce and fabrication of the carrier is simple.

Although the invention has been described in connection with tub-shaped articles, it may also be employed to hold articles of different shapes in a wrap-around carrier having a center keel. It should also be apparent that the invention need not be limited to all the specific details described in connection with the preferred embodiment, but that changes to certain features of the preferred embodiment which do not alter the overall basic function and concept of the invention may be made without departing from the spirit and scope of the invention, as defined in the claims.

What is claimed is:

1. A package comprised of a wrap-around article carrier containing a plurality of adjacent rows of articles the bottom portions of which are spaced apart, comprising:

a top panel;

first and second opposite side panels connected to the top panel;

a bottom panel comprised of a first bottom panel flap connected at a side edge thereof to the first side panel and a second bottom panel flap connected at a side edge thereof to the second side panel;

a keel extending substantially parallel to the side edges of the bottom panel flaps and being substantially equally spaced from the side panels;

the keel being comprised of opposite spaced keel side panels, a keel top panel and a keel bottom panel spaced from and opposite to the keel top panel, each keel panel being connected to an adjacent keel panel by a fold line;

one of the keel side panels being connected by a fold line to the first bottom panel flap;

the keel bottom panel being in contact with the second bottom panel flap;

the keel top panel having recesses therein, a portion of each article extending into an associated recess;

the keel side panels having openings therein, a portion of each article extending into an associated opening; and the keel bottom panel having outwardly extending tabs located between and in contact with an associated article and the bottom panel.

2. A package as defined in claim 1, wherein the keel includes an attachment flap connected to the keel bottom panel by a fold line, the attachment flap being in substantial face-to-face contact with an inner face of an adjacent keel side panel, the keel further including means for holding the attachment flap in contact with the inner face of said adjacent keel side panel.

3. A package as defined in claim 2, wherein the means for holding the attachment flap in contact with an inner face of an adjacent keel side panel comprises at least one locking tab on the attachment flap and a slot in the keel adjacent one of the openings in said adjacent side keel side panel, the locking tab extending into the slot.

4. A package as defined in claim 3, wherein the attachment flap includes a lower cutout opposite each opening in said opposite keel side panel, each attachment flap locking tab being connected to the attachment flap by a fold line.

5. A package comprised of a wrap-around article carrier containing a plurality of adjacent rows of articles the bottom portions of which are spaced apart, comprising:

a top panel;

first and second opposite side panels connected to the top panel;

a bottom panel comprised of a first bottom panel flap connected at a side edge thereof to the first side panel and a second bottom panel flap connected at a side edge thereof to the second side panel;

a keel extending substantially parallel to the side edges of the bottom panel flaps and being substantially equally spaced from the side panels;

the keel being comprised of a plurality of panels, each keel panel being connected to an adjacent keel panel by a fold line; and one of the keel panels being connected by a fold line to the first bottom panel flap;

the keel including a top keel panel having recesses therein and opposite keel side panels, a portion of each article extending into an associated recess;

each keel side panel including means for allowing the side panel to flex inwardly;

each keel side panel having an inner face;

the keel including an attachment flap in contact with the inner face of one of the keel side panels; and the means for allowing said one keel side panel to flex inwardly comprising an opening in said one keel side panel opposite each associated article, the attachment flap having locking tabs extending into slots in the keel adjacent the openings in said one keel side panel.

6. A blank for forming a wrap-around carrier for packaging a plurality of adjacent rows of articles the bottom portions of which are spaced apart, comprising:

a generally rectangular sheet having an interior top panel section;

side panel sections connected to opposite sides of the top panel section by fold lines;

a first bottom panel flap connected to one of the side panel sections along a first fold line and a second bottom panel flap connected to the other side panel section along a second fold line;

a first keel side panel section connected to one of the bottom panel flaps by a fold line;

a keel top panel section connected to the first keel side panel section by a fold line;

a second keel side panel section connected to the keel top panel section by a fold line;

a keel bottom panel section connected to the second keel side panel section by a fold line;

an attachment flap at an end of the blank, the attachment flap connected to the keel bottom panel section by a fold line;

the keel bottom panel section having transversely extending tabs formed by slits extending outwardly from the fold lines connecting the keel bottom panel section to the second keel side panel section and to the attachment flap; and means for connecting the attachment flap to the first keel side panel section in a carrier formed from the blank;

whereby in a carrier formed from the blank the keel panel sections form a keel extending substantially parallel to the side edges of the bottom panel flaps and being substantially equally spaced from the side panels of the carrier, the transversely extending tabs of the keel bottom panel section being located between the bottom panel of such a carrier and the bottoms of articles packaged in such a carrier.

7. A blank as defined in claim 6, wherein the side panel sections include heel cutouts for receiving bottom portions of articles packaged in a carrier formed from the blank.

8. A blank as defined in claim 7, wherein the keel top panel section includes narrow portions forming recesses therein for receiving a portion of each packaged article in a carrier formed from the blank.

9. A package as defined in claim 5, wherein the means for allowing the keel side panel opposite said one keel side panel to flex inwardly comprises an upper cutout adjacent each recess in the keel top panel and a lower cutout downwardly spaced from each upper cutout.

10. A package as defined in claim 9, wherein the keel side panel opposite said one keel side panel includes a slit extending from each upper cutout to an associated lower cutout.

11. A package as defined in claim 5, wherein the attachment flap includes a lower cutout opposite each opening in said opposite keel side panel, each attachment flap locking tab being connected to the attachment flap by a fold line.

12. A blank as defined in claim 6, wherein the means for connecting the attachment flap to the first keel side panel section in a carrier formed from the blank comprises outwardly extending locking tabs and the fold line connecting the first keel panel section to the keel top panel section includes slots aligned with the locking tabs, the locking tabs fitting into the slots in a carrier formed from the blank.

* * * * *